US007633370B2

(12) United States Patent
Benke et al.

(10) Patent No.: US 7,633,370 B2
(45) Date of Patent: Dec. 15, 2009

(54) FUSE MOUNTING MEMBER

(75) Inventors: James Jeffery Benke, Pittsburgh, PA (US); Robert Neville Parry, Beaver, PA (US); Collin Christopher Otis, Cecil Township, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 12/395,911

(22) Filed: Mar. 2, 2009

(65) Prior Publication Data

US 2009/0160598 A1 Jun. 25, 2009

Related U.S. Application Data

(62) Division of application No. 11/624,527, filed on Jan. 18, 2007.

(51) Int. Cl.
*H01H 85/17* (2006.01)
*H01H 85/042* (2006.01)

(52) U.S. Cl. ..... 337/202; 337/168; 337/180; 337/187

(58) Field of Classification Search ..... 337/168, 337/180, 202, 187
See application file for complete search history.

(56) References Cited

U.S. PATENT DOCUMENTS

| | | | | | |
|---|---|---|---|---|---|
| 1,856,122 | A * | 5/1932 | Austin | 361/301.1 |
| 2,277,024 | A * | 3/1942 | Ruska et al. | 250/311 |
| 2,606,954 | A * | 8/1952 | Baker | 174/158 R |
| 2,961,518 | A * | 11/1960 | Hermann | 200/294 |
| 3,594,676 | A * | 7/1971 | Misare | 337/180 |
| 3,648,211 | A * | 3/1972 | McKeithan | 337/202 |
| 3,868,615 | A * | 2/1975 | Haubein et al. | 337/169 |
| 3,898,372 | A * | 8/1975 | Kalb | 174/179 |
| 4,212,696 | A * | 7/1980 | Lusk et al. | 156/294 |
| 4,656,555 | A * | 4/1987 | Raudabaugh | 361/117 |
| 4,870,387 | A * | 9/1989 | Harmon | 337/168 |
| 5,098,752 | A * | 3/1992 | Chang et al. | 428/34.9 |
| 5,191,311 | A * | 3/1993 | Webb et al. | 337/168 |
| 5,220,134 | A * | 6/1993 | Novel et al. | 174/179 |
| 5,300,912 | A * | 4/1994 | Tillery et al. | 337/180 |
| 5,406,033 | A * | 4/1995 | Pazdirek | 174/176 |
| 5,448,019 | A * | 9/1995 | Berlovan, Jr. | 174/182 |
| 5,986,216 | A * | 11/1999 | Krause | 174/179 |
| 6,229,094 | B1 * | 5/2001 | Krause | 174/177 |
| 6,593,842 | B2 * | 7/2003 | Haynam et al. | 337/171 |
| 6,875,929 | B2 * | 4/2005 | Wermelinger | 174/156 |
| 6,952,154 | B2 * | 10/2005 | Almgren et al. | 337/202 |
| 2003/0080848 | A1 * | 5/2003 | Krause et al. | 337/19 |
| 2003/0159849 | A1 * | 8/2003 | Wermelinger | 174/156 |

* cited by examiner

*Primary Examiner*—Anatoly Vortman
(74) *Attorney, Agent, or Firm*—Martin J. Moran

(57) ABSTRACT

A fuse mounting assembly includes an epoxy-bonded glass-fiber core that is surrounded by a resilient sleeve having a number of radially extending members. Attached to an end of the core is a first mounting bracket and attached to another end of the core is another mounting bracket. Each of the mounting brackets is connected to a fuse which is structured to protect a power circuit.

11 Claims, 3 Drawing Sheets

FUSE MOUNTING MEMBER

This application is a divisional of application Ser. No. 11/624,527, filed Jan. 18, 2007, and entitled "Fuse Mounting Member".

BACKGROUND OF THE INVENTION

1. Field of the Invention

This invention relates generally to fuses and, more particularly, to an outdoor fuse mounting assembly.

2. Background Information

A fuse is a type of overcurrent protection device for installation into a power circuit. A fuse has an element (or a plurality of elements), which is typically a metal wire or conductive strip or other conductor, which will melt, sever, or otherwise open when heated by a predetermined electrical current for a predetermined time. Accordingly, fuses are generally designed to allow the flow of an electrical current up to a certain current-time threshold. Once the current-time threshold is crossed, the element in the fuse opens, thereby protecting the power circuit from the overcurrent condition.

Fuses can be installed in a variety of environments. For example, a fuse can be installed into a power circuit that is located outdoors or, alternatively, the fuse can be installed into a power circuit that is located indoors. A fuse that is installed into an outdoor power circuit is typically mounted onto a mounting assembly which is made from a ceramic material. A ceramic mounting assembly, however, has a number of shortcomings. For instance, an outdoor ceramic mounting assembly is typically exposed to a variety of environmental conditions, such as inclement weather, which can damage (e.g., crack) the ceramic mounting assembly. Moreover, an outdoor ceramic mounting assembly can be damaged during transit to the installation site thereby rendering the outdoor ceramic mounting assembly useless.

SUMMARY OF THE INVENTION

Various needs are met by various embodiments of the invention which provides a fuse mounting assembly comprising at least one epoxy-bonded glass-fiber core that is surrounded by at least one resilient sleeve which has a number of radially extending members.

In accordance with one embodiment of the invention, a fuse mounting assembly comprises a first core and a second core. Each of the first and second cores have a first end, a second end, and an outer perimeter. First and second mounting brackets are connected to the first end of the first core and the second end of the second core, respectively, while a third mounting bracket is disposed between the second end of the first core and the first end of the second core. A resilient sleeve having a number of radially extending members is disposed around the outer perimeter of the first core while another resilient sleeve having a number of radially extending members is disposed around the outer perimeter of the second core.

In accordance with another embodiment of the invention, a fuse mounting assembly comprises a core having a first end, a second end, and an outer perimeter. A mounting bracket is connected to the first end of the core, and another mounting bracket is connected to the second end of the core. A resilient sleeve having a number of radially extending members is disposed around the outer perimeter of the core.

In accordance with yet another embodiment of the invention, a fuse mounting assembly comprises a first core and a second core. Each of the first and second cores has a first end, a second end, and an outer perimeter. First and second mounting brackets are connected to the first end of the first core and the second end of the second core, respectively, while a third mounting bracket is disposed between the second end of the first core and the first end of the second core. A resilient sleeve having a number of radially extending members is disposed around the outer perimeter of the first core while another resilient sleeve having a number of radially extending members is disposed around the outer perimeter of the second core. A fuse is connected to each of the first and second mounting brackets.

In accordance with yet another embodiment of the invention, a fuse mounting assembly comprises a core having a first end, a second end, and an outer perimeter. A mounting bracket is connected to the first end of the core, and another mounting bracket is connected to the second end of the core. A number of individual discs are disposed around the outer perimeter of the core.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
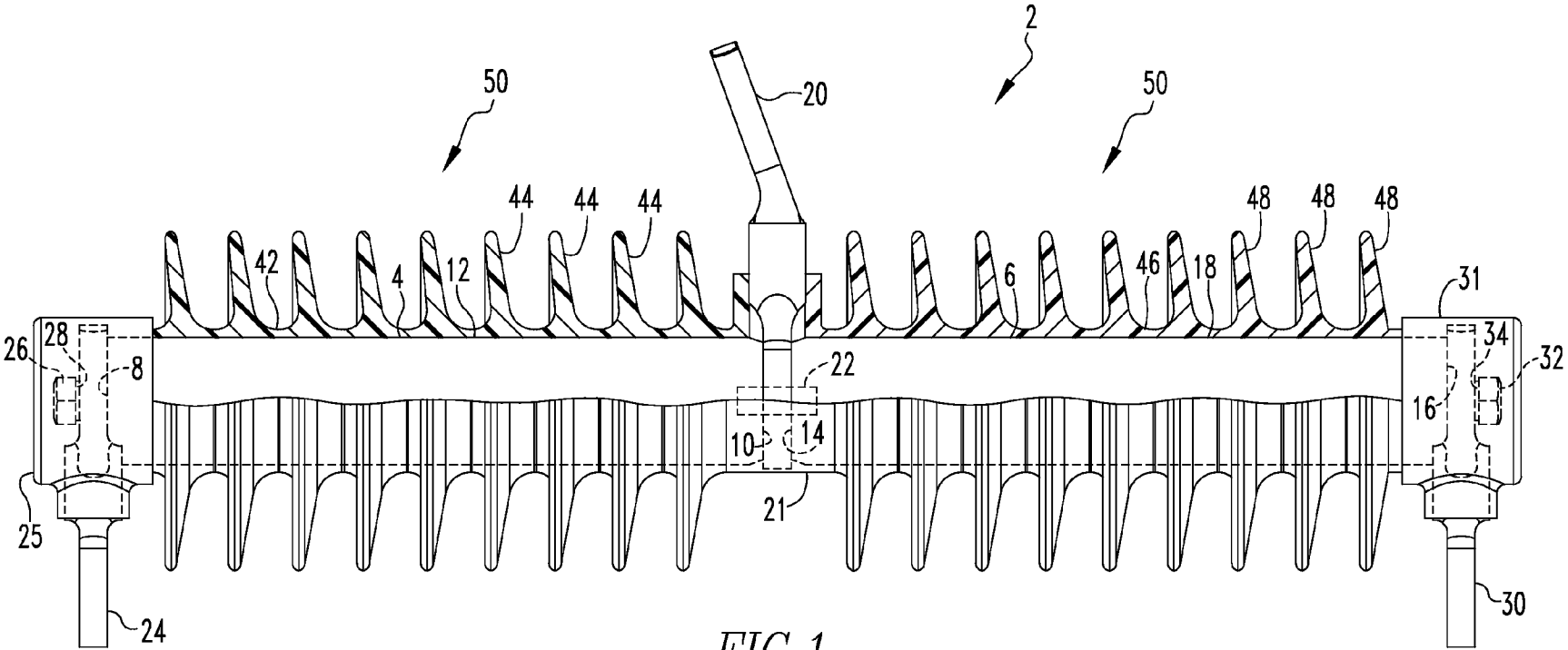
FIG. 1 is a side elevational view of the fuse mounting assembly in accordance with an embodiment of the invention.

As employed herein, the term "number" means one or an integer greater than one (i.e., a plurality).

As employed herein, the term "mechanical fastener" or variations thereof shall refer broadly to any suitable fastening, connecting or tightening mechanism including, but not limited to, screws, bolts, and the combination of bolts and nuts.

As employed herein, the term "ceramic" or variations thereof shall refer broadly to an inorganic insulative material or a non-metallic insulative material.

As employed herein, the term "silicone" or variations thereof shall refer broadly to a polymer which has a backbone structure of silicon-oxygen or some other silicon based polymer that can be used for electrical insulation purposes. For example, without limitation, the silicone can be silicone rubber.

As employed herein, the term "medium voltage fuse" or variations thereof shall refer to a fuse suitable for use in a power circuit having a voltage ranging from about 1.0 kilovolts to about 69.0 kilovolts.

As employed herein, the term "electrical creepage" or variations thereof shall refer to the shortest distance along a continuous insulating surface between two conducting bodies that would normally be at different electrical potentials.

When referring to any numerical range of values, such ranges are understood to include each and every number and/or fraction between the stated range minimum and maximum.

Directional phrases used herein, such as, for example, upper, lower, left, right, vertical, horizontal, top, bottom, above, beneath, clockwise, counterclockwise and derivatives thereof, relate to the orientation of the elements shown in the drawings and are not limiting upon the claims unless expressly recited therein.

As stated above, one shortcoming of a ceramic fuse mounting assembly is that the ceramic fuse mounting assembly can be damaged (e.g., cracked) by inclement weather or improper handling during transport to an installation site. Accordingly, there is a need for a fuse mounting assembly that is not only resistant to environmental conditions, but is resistant to conditions that can arise during transport as well.

These needs, and others, are met by various embodiments of the invention which provide a fuse mounting assembly for use with a fuse, such as a medium voltage fuse, which comprises at least one epoxy-bonded glass-fiber core that is surrounded by at least one resilient sleeve which has a number of radially extending members.

Figure 2:
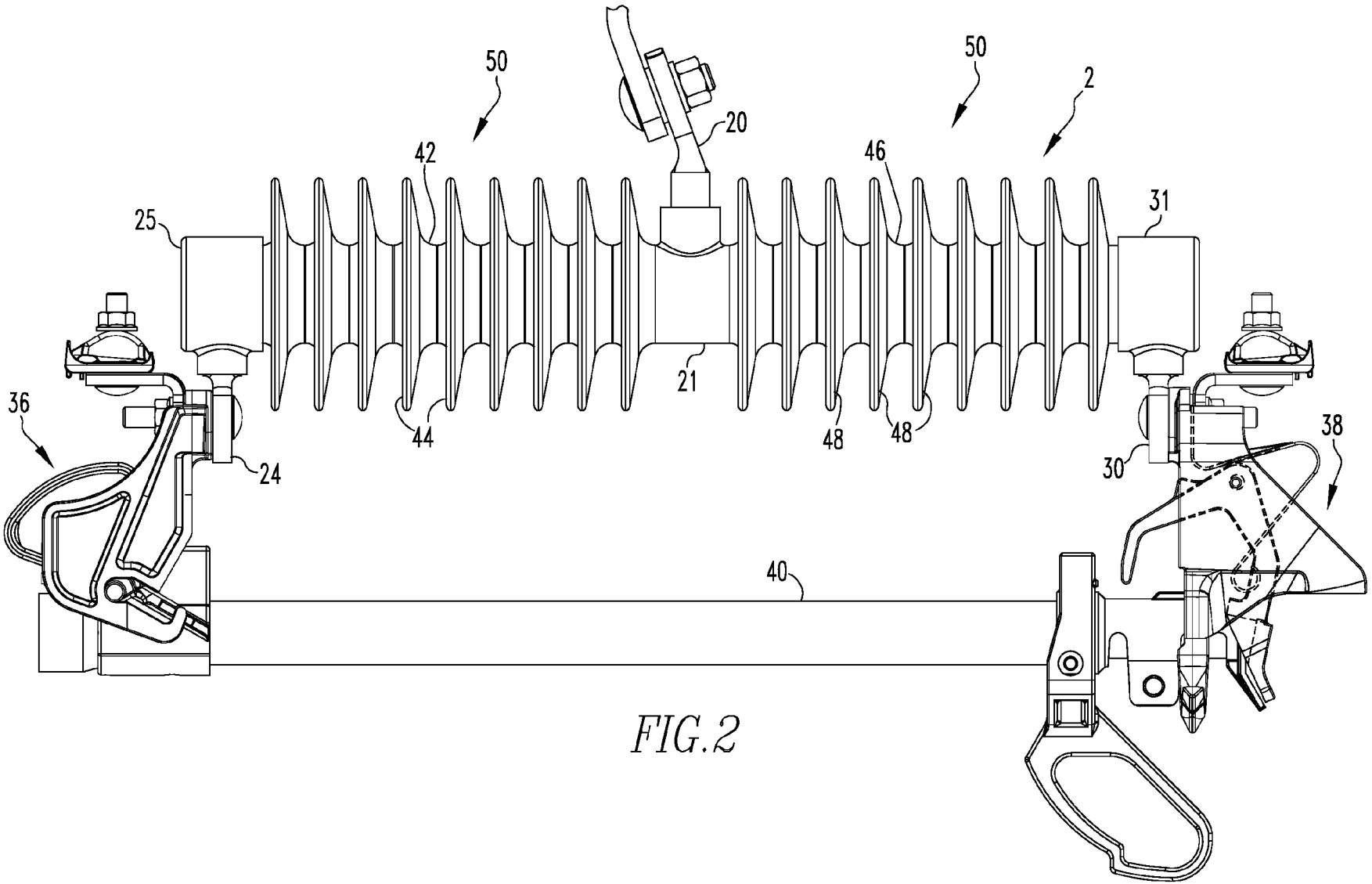
FIG. 2 is a side elevational view of a fuse that is mounted to the fuse mounting assembly of FIG. 1.
Figure 3:
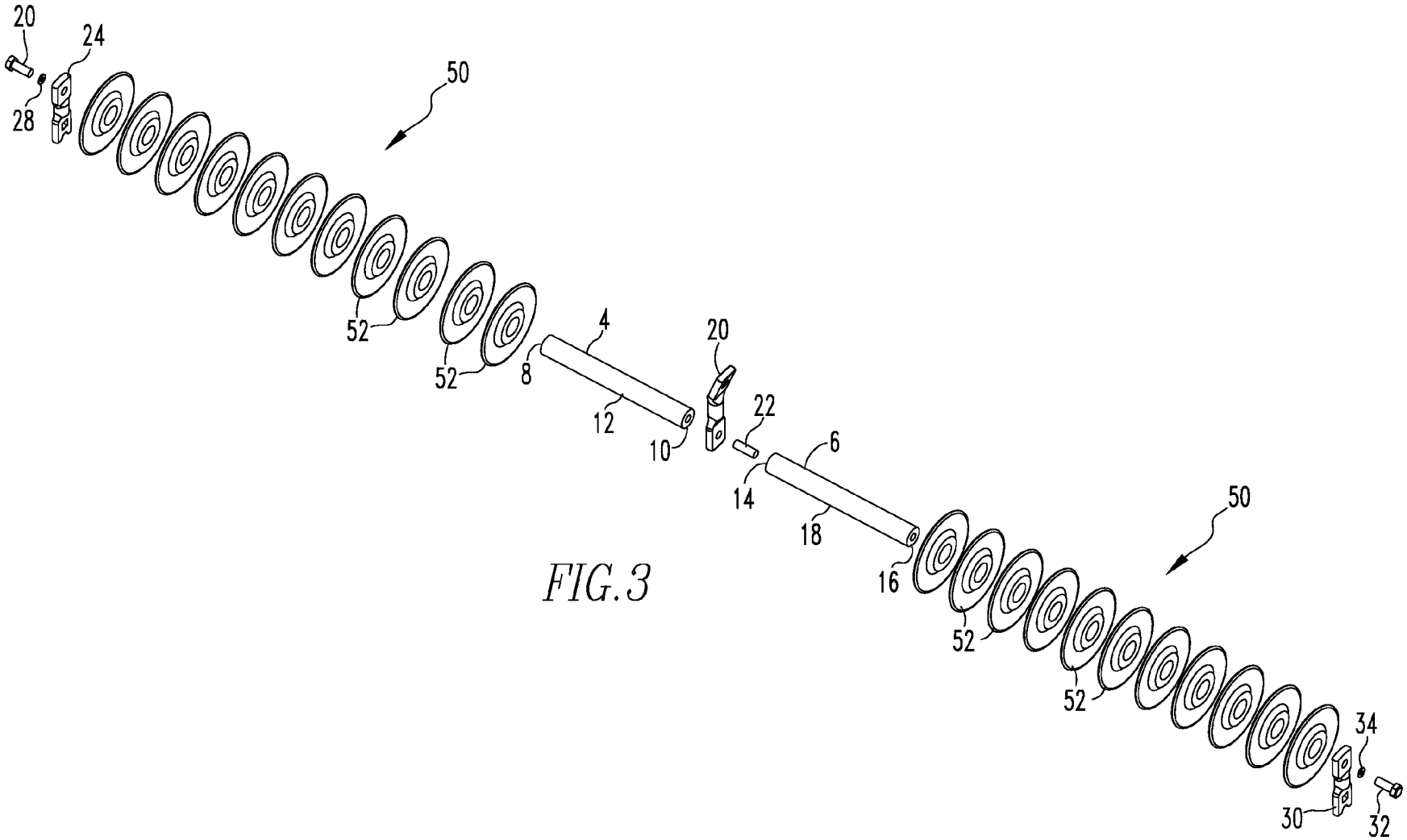
FIG. 3 is an exploded view of the fuse mounting assembly in accordance with another embodiment of the invention.

Referring to FIGS. 1-3, in accordance with one embodiment of the invention, a fuse mounting assembly 2 is comprised of a first core structure (first core) 4 and a second core structure (second core) 6. The first core 4 has a first end 8, a second end 10, and an outer perimeter 12. Similarly, the second core 6 also has a first end 14, a second end 16, and an outer perimeter 18. In one embodiment, each of the first and second cores 4,6 is manufactured from an epoxy-bonded glass-fiber material or a ceramic material that imparts rigidity to the first and second cores 4,6. In another embodiment, a filament wound material, which comprises a number of glass filaments coated with an epoxy, is used to manufacture the first and second cores 4,6. If a filament material is used, then each of the first and second cores 4,6 is created by winding the filament material into a desired shape such as, without limitation, a substantially cylindrical shape. It should be noted, however, that the shape of the first and second cores 4,6 is not limited to a cylindrical shape and that other shapes, such as those having a rectangular or triangular cross section, fall within the scope of this invention. The advantage of using an epoxy-bonded glass-fiber material, as opposed to a ceramic core, is that a core made from an epoxy-bonded glass-fiber material is more resistant to damage that might be caused by inclement weather. Additionally, the likelihood of such a core being damaged during transit to an installation site is lower that that of a ceramic core.

Continuing with FIG. 1, the first and second cores 4,6 are connected by a third mounting bracket 20 that is disposed between the first and second cores 4,6. Specifically, the third mounting bracket 20 is positioned between the second end 10 of the first core 4 and the first end 14 of the second core 6. The third mounting bracket 20 further includes a mechanical fastener 22 that extends through an aperture (not shown) in the third mounting bracket 20. On end of the mechanical fastener 22 is received into a threaded aperture (not shown) disposed within the interior of each core 4,6 thereby securing the first core 4 to the second core 6 and sandwiching the third mounting bracket 20 between the first and second cores 4,6. Typically, the third mounting bracket 20 is used to mount the fuse mounting assembly 2 to another structure such as a utility pole (not shown). In another embodiment, the first and second cores 4,6 are connected by welding a metal insert (not shown) that is disposed at the second end 10 of the first core 3 to another metal insert (not shown) that is disposed at the first end 14 of the second core 6. In one embodiment, the metal inserts are disposed within the interior of each of the first and second cores 4,6. In another embodiment, the metal inserts surround a portion of the outer perimeter 12,18 of the first and second cores 4,6, respectively. In yet another embodiment, one or both of the metal inserts extend through an aperture in the third mounting bracket 20.

Disposed at the first end 8 of the first core 4 is a first mounting bracket 24 that is secured to the first core 4 by a mechanical fastener 26 and a washer 28. Disposed at the second end 16 of the second core 6 is a second mounting bracket 30 that is secured to the second core 6 by a mechanical fastener 32 and a washer 34. The first and second mounting brackets 24,30 are adapted to connect with first and second fuse mounting members 36,38, respectively, which are adapted to receive a fuse 40 (see FIG. 2) that is inserted into an electrical circuit (not shown). The first, second, and third mounting brackets 24,30,20 can also be enclosed by a protective covering 25,31,21 (see FIGS. 1 and 2), which shields a portion of each mounting bracket 24,30,20 from the elements (e.g., without limitation, rain, snow, sleet).

Referring to FIGS. 1-2, surrounding the outer perimeter 12 of the first core 4 is a resilient sleeve 40 which has a number of radially extending members 44. Surrounding the outer perimeter 18 of the second core 6 is another resilient sleeve 46 having a number of radially extending members 48. In one embodiment, the resilient sleeves 40,46 and their associated radially extending members 48 are an integrated unit (i.e., made as a monolithic unit). In another embodiment, the resilient sleeves 40,46 are bonded to the outer perimeter of the cores 4,6 that they surround via an adhesive. In other embodiments, however, a number of individual discs 52 could be installed around each of the first and second cores 4,6 in lieu of the resilient sleeves 40,46 (FIG. 3). The resilient sleeves 40,46 as well as the individual discs 50 can be made from resilient materials such as, without limitation, silicone, rubber, or epoxy. For clarity, hereinafter, the radially extending members 44,48 and the individual discs 52 shall be collectively referred to as discs 50.

In general, the discs 50 each have a diameter that is larger than the diameter of each of the first and second cores 42. However, despite FIGS. 1-3 depicting each of the discs 50 as having the same diameter, discs 50 having different diameters may also be mounted onto the first core 4 and/or the second core 6. In one embodiment, each of the first and second cores 4,6 has nine discs 50 although any suitable number of silicone discs 50 may be employed.

When a force is applied to a disc 50, the disc 50 is able to flex thereby absorbing the force. Accordingly, the discs 50 are able to absorb a force that would otherwise damage a ceramic fuse mounting assembly during transit to an installation site. Once the force has dissipated, the discs 50 will return to their original configuration (shape). Due to the resilient nature of the discs 50, the disclosed fuse mounting assembly 2 will, typically, not be damaged if the fuse mounting assembly 2 is jostled during transport. Moreover, the discs 50 also provides a degree of protection for the first and second cores 4,6 in the event that a random object might strike the first and second cores 4,6. In addition to having the ability to absorb various forces which the fuse mounting assembly 2 might encounter, the discs 50 also increases the electrical creepage distance of the fuse mounting assembly 2 thereby preventing electricity from traveling along the surface of the fuse mounting assembly 2. Yet another advantage that is provided by the discs 50 is that the shape of the discs 50 is conducive to inhibiting water from remaining (pooling) on a surface of the disc 50. One advantage that is derived from preventing water, such as contaminated water (e.g., water that is contaminated with salt and/or some type of industrial contaminant), from pooling on the surface of the disc 50 is that it preserves the electrical insulating capabilities of the disc 50 from the high electrical conductivity of the contaminated water.

In another embodiment of the invention, the first and second cores 4,6 may be replaced with a single core that is manufactured from an epoxy-bonded glass-fiber material or a ceramic material. Disposed around the outer perimeter of the single core could either be a single resilient sleeve, which has a number of radially extending members, or a number of individual discs 52. For example, a single resilient sleeve with eighteen radially extending members could be disposed around the outer perimeter of the single core. Alternatively, eighteen individual discs 52 could be disposed around the outer perimeter of the single core as well. It should be noted, however, that any suitable number of discs 50 could be disposed around the outer perimeter of the single core. In one embodiment, a third mounting bracket 20 is disposed around the outer perimeter of the single core.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A fuse mounting assembly comprising:

a first core having a first end, a second end, and an outer perimeter;

a second core having a first end, a second end, and an outer perimeter;

a first mounting bracket connected to said first end of said first core;

a second mounting bracket connected to said second end of said second core;

a third mounting bracket disposed between said second end of said first core and said first end of said second core; and a number of individual discs disposed around said outer perimeter of said first and second cores, wherein said third mounting bracket includes an aperture and a mechanical fastener connecting each of said first and second cores to said third mounting bracket, said mechanical fastener extending through said aperture.

2. The fuse mounting assembly according to claim 1, wherein said individual discs is made from silicone, rubber, or epoxy.

3. The fuse mounting assembly according to claim 1, wherein said first and second cores are made from an epoxy-bonded glass-fiber material.

4. The fuse mounting assembly according to claim 3, wherein said an epoxy-bonded glass-fiber material is a filament wound material.

5. The fuse mounting assembly according to claim 1, wherein said third mounting bracket is sandwiched between said first and second cores.

6. A fuse mounting assembly comprising:

a first core having a first end, a second end, and an outer perimeter;

a second core having a first end, a second end, and an outer perimeter;

a first mounting bracket connected to said first end of said first core;

a second mounting bracket connected to said second end of said second core;

a third mounting bracket disposed between said second end of said first core and said first end of said second core; and a number of individual discs disposed around said outer perimeter of said first and second cores, wherein said third mounting bracket includes a mechanical fastener connecting each of said first and second cores to said third mounting bracket, and wherein each end of said mechanical fastener is received into a threaded aperture disposed within the interior of a corresponding one of said first and second cores, thereby securing said first core to said second core.

7. The fuse mounting assembly according to claim 6, wherein said number of individual discs is made from silicone, rubber, or epoxy.

8. The fuse mounting assembly according to claim 6, wherein said first and second cores are made from an epoxy-bonded glass-fiber material.

9. The fuse mounting assembly according to claim 8, wherein said epoxy-bonded glass-fiber material is a filament wound material.

10. The fuse mounting assembly according to claim 6, wherein said third mounting bracket is sandwiched between said first and second cores.

11. The fuse mounting assembly according to claim 6, wherein said third mounting bracket includes an aperture, and wherein said mechanical fastener extends through said aperture.

* * * * *